US005845172A

United States Patent [19]

Saito et al.

[11] Patent Number: 5,845,172

[45] Date of Patent: Dec. 1, 1998

[54] IMAGE FORMING APPARATUS HAVING ROTATABLE CHARGING BRUSH WITH VARYING CHARGING VOLTAGE

[75] Inventors: Hitoshi Saito, Mie-Ken; Masashi Yamamoto, Settsu; Makoto Shimazoe, Toyokawa, all of Japan

[73] Assignee: Minolta Co., Ltd., Osaka, Japan

[21] Appl. No.: 748,005

[22] Filed: Nov. 12, 1996

Related U.S. Application Data

[63] Continuation of Ser. No. 555,778, Nov. 9, 1995, abandoned.

[30] Foreign Application Priority Data

Nov. 9, 1994 [JP] Japan ..... 6-274741

[51] Int. Cl.[6] ..... G03G 15/02

[52] U.S. Cl. ..... 399/50; 399/169

[58] Field of Search ..... 399/98–100, 168, 399/169, 50; 361/225

[56] References Cited

U.S. PATENT DOCUMENTS

| | | | |
|---|---|---|---|
| 5,103,265 | 4/1992 | Kohyama | 399/150 |
| 5,148,219 | 9/1992 | Kohyama | 355/219 |
| 5,221,946 | 6/1993 | Kohyama | 355/270 |
| 5,321,471 | 6/1994 | Ito et al. | 399/129 |
| 5,371,578 | 12/1994 | Asano et al. | 399/100 |
| 5,508,788 | 4/1996 | Watanabe et al. | 399/175 |
| 5,541,717 | 7/1996 | Saito et al. | 399/150 |

FOREIGN PATENT DOCUMENTS

| | | |
|---|---|---|
| 1-232371 | 9/1989 | Japan . |
| 3-4283 | 1/1991 | Japan . |
| 4-20986 | 1/1992 | Japan . |
| 4-37776 | 2/1992 | Japan . |

*Primary Examiner*—Arthur T. Grimley
*Assistant Examiner*—Quana Grainger
*Attorney, Agent, or Firm*—Sidley & Austin

[57] ABSTRACT

In order to achieve such effects that memories such as image memory due to untransferred residual toner can be sufficiently prevented, and good images can be obtained by suppressing base fogging and reduction of entire image density for a long term, an oscillating voltage composed of a DC ingredient and an oscillating ingredient is applied to a charging device for charging a photosensitive member, while the charging device is in a position facing an image forming region of the photosensitive member. While the charging device is in a position facing an image non-forming region of the photosensitive member, only a DC voltage is applied to the charging device for at least a predetermined time.

16 Claims, 8 Drawing Sheets

IMAGE FORMING APPARATUS HAVING ROTATABLE CHARGING BRUSH WITH VARYING CHARGING VOLTAGE

This application is a continuation of application Ser. No. 08/555,778, filed Nov. 9, 1995 now abandoned.

BACKGROUND OF THE INVENTION

1. Field of the Invention

The present invention relates to an electrophotographic image forming apparatus such as a copying machine and a printer.

2. Description of the Related Art

In a conventional electrophotographic image forming apparatus such as a copying machine and a printer, image formation is performed through the following steps:

(1) A charging device charges a photosensitive member.

(2) An image exposure device effects image exposure on a charged area on the photosensitive member to form an electrostatic latent image.

(3) A developing device electrostatically adheres developer (toner) onto the electrostatic latent image to form a visible toner image.

(4) A cleaning device operates to remove residual toner which remains on the photosensitive member without being transferred.

In recent years, reduction of sizes and costs of image forming apparatuses have been demanded. In order to comply with this, such an image forming apparatus has been proposed and disclosed, e.g., in Japanese Laid-Open Patent Publication No. 3-4283 (4283/1991) that a dedicated cleaning device is eliminated, and a developing device is also used as a cleaning device.

In this apparatus, a toner image is formed by supplying toner to an electrostatic latent image in a reversal development manner, and at the same time, the developing device functions to clean up untransferred toner remaining on the photosensitive member after the transfer. Further, there is provided a contact charging device including a rotary charging brush which can uniformly charge the photosensitive member prior to formation of the electrostatic latent image, and the contact charging device is intended to disturb the untransferred residual toner into an unpatterned form simultaneously with charging of the photosensitive member. Owing to disturbing of the untransferred residual toner into an unpatterned form, it can be expected to prevent such situations that the untransferred residual toner will remain on the photosensitive member to impede uniform charging and to cause a defective exposure (so-called kicking of exposure) in the next exposing step, which results in occurrence of a so-called image memory. Thus, it is intended to prevent impairment of formation of the electrostatic latent image at the next step. It is also intended to prevent such a situation that the untransferred residual toner is transferred onto a transfer member at the next step and thus a residual memory (retransferred memory) occurs.

Japanese Laid-Open Patent Publication No. 4-20986 (20986/1992) discloses a similar image forming apparatus, in which an electrically conductive elastic member (rotary brush in the embodiment) is slidingly in contact with a photosensitive member, and a voltage composed of a DC (direct current) component and an AC (alternating current) component superposed thereon is applied to the electrically conductive elastic member, so that untransferred residual toner on the photosensitive member is disturbed into an unpatterned form, and simultaneously the photosensitive member is charged, whereby uniformity in charging is further improved and an image memory is further suppressed.

The image memory is a phenomenon wherein, in the image forming apparatus for forming an image in a reversal development method, untransferred residual toner intercepts a new image exposure and thus prevents sufficient damping of the potential at the surface of the photosensitive member, so that a portion corresponding to the untransferred residual toner pattern lowers the new image density or remains as a blank.

However, in the above image forming apparatus simultaneously performing developing and cleaning, the following problem arises.

In the image forming apparatus disclosed in Japanese Laid-Open Patent Publication No. 3-4283, only a DC voltage is applied to the charging device, in which case generation of the image memory cannot be prevented sufficiently.

In a printer of a resolution of 300 dpi to which the above concept is applied, if a dot-half image of a printing ratio of 25% is to be printed by performing exposure on alternate dots in primary and secondary scanning directions, portions corresponding to solid images, characters and/or line images formed during the most recent rotation of the photosensitive member may not have a sufficient image density or may be left blank, resulting in a negative memory and thus defective images.

In the case where an image is formed by applying to the rotary brush charging device an oscillating voltage composed of a DC component and an oscillating component added thereto as taught by Japanese Laid-Open Patent Publication No. 4-20986, repetition of image formation increases the degree of base fogging, i.e., toner adhesion as a background of an image, and, in the worst case, only a defective image such as an image of entirely low density can be obtained.

The reasons for the above may be as follows:

(1) The untransferred residual toner, which was not transferred onto a transfer member (generally, a transfer sheet of paper) by the transferring device, contains a large amount of oppositely charged toner having a polarity opposite to the normal charged polarity. Meanwhile, the rotary brush charging device is supplied with an oscillating voltage of which the peak-to-peak voltage ($V_{p-p}$) is sufficiently increased for sufficiently suppressing a memory. Therefore, the oppositely charged toner tends to adhere electrostatically onto the rotary charging brush and be accumulated thereon.

(2) The oscillating voltage effects charging and decharging on the photosensitive member. Simultaneously, it effects charging and decharging on the untransferred residual toner. As a result, charges on the residual toner hardly change, and the oppositely charged toner substantially maintains its polarity, so that it adheres to and is accumulated on the rotary charging brush.

(3) Since reversal developing is performed, it is difficult to collect the oppositely charged toner into the developing device.

(4) If a large amount of toner is accumulated on the rotary brush charging device in accordance with repetition of image formation, the toner on the rotary brush adheres to the photosensitive member again, so that the toner adhering to the photosensitive member increases in quantity.

Due to the reasons described above and other reasons, the developing device cannot sufficiently collect the toner, the quantity of toner accumulated on the photosensitive member increases, and the toner on the photosensitive member partially adheres to the transfer member in the transferring section, so that the degree of base fogging undesirably increases. In the worst case, a large amount of residual toner exists on the photosensitive member, so that a new image exposure is entirely intercepted, and thus a potential cannot be reduced at a portion of the photosensitive member of which the potential is to be lowered by the image exposure, resulting in a reduction of the entire density of the image.

SUMMARY OF THE INVENTION

Accordingly, it is an object of the invention to provide an image forming apparatus, in which a developing device for developing an electrostatic latent image can also collect toner remaining on a photosensitive member after transfer, and in particular an electrophotographic image forming apparatus in which a memory due to untransferred residual toner on the photosensitive member can be sufficiently prevented, and good images can be obtained by preventing unignorable base fogging and reduction of an entire image density for a long term.

In order to achieve the above objects, the present invention provides an image forming apparatus including a photosensitive member, a charging device for charging the surface of the photosensitive member to form an electrophotographic latent image by image exposure, a power source for applying electric power to the charging device, a developing device for developing the latent image and collecting developer remaining on the photosensitive member after transferring the developed image to a transfer member, a control means for controlling the power source to apply an oscillating voltage composed of a direct current component and an alternating current component to the charging device while the charging device faces a part of the photosensitive member in which an image is to be formed, and to apply only a direct current voltage to the charging device for at least a predetermined time while the charging device faces a part of the photosensitive member in which no image is to be formed.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
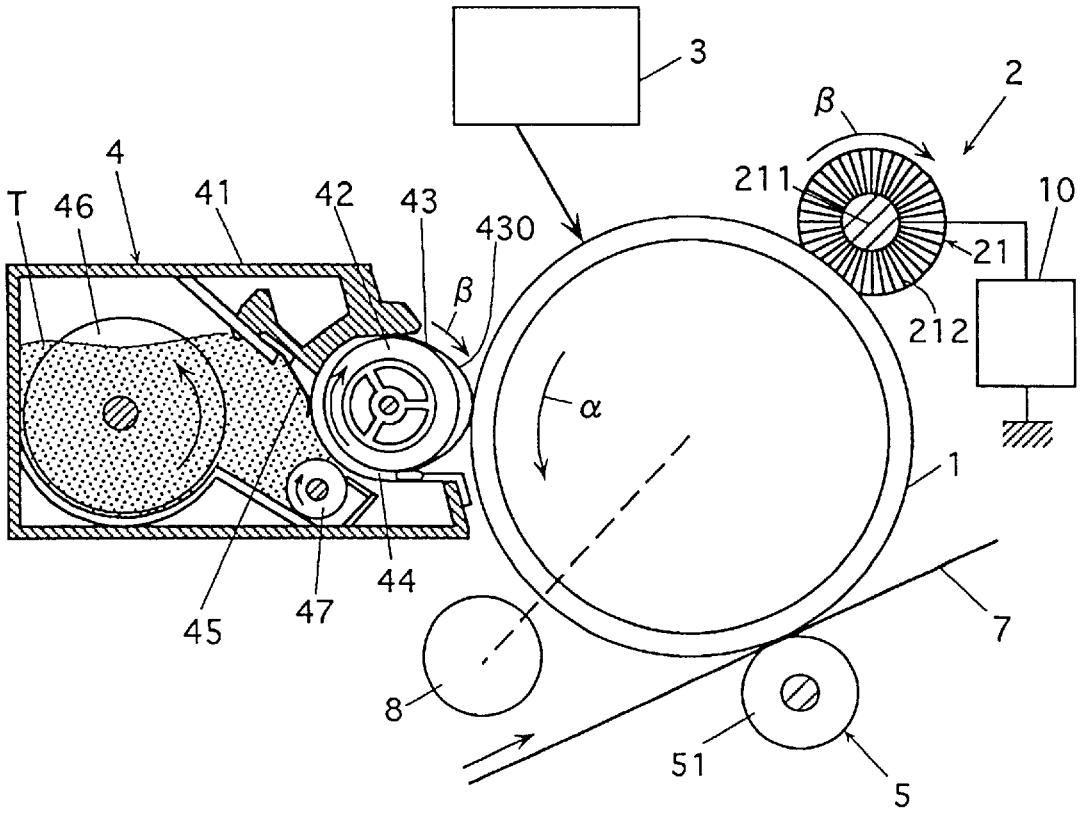
FIG. 1 schematically shows a structure of a major portion of a printer of an embodiment of the invention.

Embodiments of the invention will be described below. Image forming apparatuses of the following embodiments are based on the following finding and knowledge.

While a rotary contact charging device is passing relatively over at least an image forming region on a photosensitive member, an oscillating voltage formed of a DC component and an oscillating component added thereto is applied to the charging device so as to charge the photosensitive member and to disturb untransferred residual toner into an unpatterned form. An image non-forming region on the photosensitive member is charged by applying a voltage formed of only a DC component thereto at least for a predetermined period (i.e., in accordance with a predetermined timing), while the charging device is passing relatively over a surface portion of the photosensitive member corresponding to one or more sequences or steps such as a pre-sequence (a so-called warming-up period and a subsequent image formation standby period) after activation of the image forming apparatus and before the start of the image formation, an inter-image sequence between transfer members during continuous image formation, and an end sequence after discharge of the image-formed transfer member from the apparatus and before stopping of the image forming apparatus. Thereby, in the image forming region, the contact charging device physically disperses the toner, and the applied oscillating voltage sufficiently disturbs the untransferred residual toner into an unpatterned form, so that the photosensitive member can be uniformly charged, and generation of a memory such as an image memory can be sufficiently suppressed. With respect to the image non-forming region, application of the voltage formed of only a DC component can charge defectively charged toner such as oppositely charged toner to have the normal polarity, whereby accumulation of toner in the charging device can be suppressed, and the developing device can sufficiently collect the untransferred residual toner.

Any power source is applicable to the present invention as far as applying an oscillating voltage to the charging device while the charging device faces a part of the photosensitive member in which an image is to be formed, and applying only a direct current voltage to the charging device for at least a predetermined time while the charging device faces a part of the photosensitive member in which no image is to be formed.

Further, the control means can be one which switches the direct current voltage applied by the power source from a first to a second level to release developer adhering to the charging device onto the photosensitive member, and thereafter may switch the direct current voltage from the second level to the first level for charging the released developer to have a normal polarity. In this case, a gap of potential at the second level with respect to a ground voltage is smaller than that at the first level.

The second level may be a ground voltage or 0V.

The control means may apply the oscillating voltage by periodically switching the direct current voltage applied by the power source, e.g., in accordance with periodical on/off by a pulse control signal. Employment of this control means can eliminate an AC power source, which can reduce the size and cost of the image forming apparatus.

As another example of the power source, there may be provided a DC power source for applying direct current electric power to the charging device, and an AC power source for applying alternating current electric power to the charging device. In this case, the control means operates both the DC power source and AC power source while the charging device faces a portion of the photosensitive member in which the latent image is to be formed by the exposure device, and operates only the DC power source for at least a predetermined time while the charging device faces the rest portion of the photosensitive member.

In the case where the power source includes the AC and DC power sources, the control means may be operated to switch the voltage to be applied during a period for operating only the DC power source from a first level to a second level so as to release developer adhering to the charging device onto the photosensitive member, and thereafter switch the voltage to be applied from the second level to the first level. In addition to this, for charging the released developer on the photosensitive member to have a normal polarity, the control means may be operated to rotate the photosensitive member more than one rotation (For example, one rotation of the photosensitive member and a fraction corresponding to a distance along the surface of the photosensitive member between the charging device and the developing device). In this case, a gap of potential at the second level with respect to a ground voltage is smaller than that at the first level.

Also in this case, the second voltage may be a ground voltage or 0V.

In any one of the above cases, the image forming apparatus according to the invention may employ the developing device which develops the latent image with a mono-component developer.

In the image forming apparatus according to the invention, a waveform of the oscillating component of the oscillating voltage applied to the charging device is not specifically restricted, and may be a sinusoidal, square, saw-tooth-like or triangular waveform, provided that a peak-to-peak voltage $V_{p-p}$ is large enough to prevent the memory. The oscillating voltage of frequency between about 30 to 200 Hz can be obtained by the foregoing periodical switching such as switching with a pulse signal of a predetermined frequency with a single DC voltage source without using an AC voltage source, and application of the oscillating voltage and application of the DC voltage can be performed with the single DC voltage source.

[Embodiment 1]

A first embodiment of the invention will now be described below with reference to the drawings. FIG. 1 schematically shows a structure of a major portion of a printer of the first embodiment.

The printer is provided with a photosensitive drum 1, which is driven to rotate counterclockwise (in the direction of arrow α in the figure) at a predetermined peripheral speed Vpc. Around the photosensitive drum 1, there are successively arranged a rotary contact charging device 2 having a charging rotary brush 21, an image exposing device 3, a developing device 4 and a transfer device 5 having a transfer roller 51.

The photosensitive drum 1, the rotary brush 21, rotary portions in the developing device 4, the transfer roller 51 in the transfer device 5 and others are driven to rotate by a main electric motor 8.

The photosensitive drum 1 has a diameter of 30 mm, and its peripheral speed Vpc is 37.77 mm/sec.

The rotary brush 21 of the charging device 2 includes a shaft 211 made of metal and having a diameter of 8 mm (generally, about 4–10 mm) and electrically conductive brush fibers 212 arranged radially around the shaft 211. The rotary brush 21 rotates in a direction opposite to that of the photosensitive drum 1, i.e., clockwise direction indicated by arrow β, and its peripheral speed is two to four times as large as the peripheral speed Vpc of the photosensitive drum 1. The rotary brush 21 rotates in contact with the surface of the photosensitive drum 1, and a power source 10 applies a charging voltage Vc to the rotary brush 21, so that the rotary brush 21 can uniformly charge the surface of the photosensitive drum 1 to a predetermined potential in the range of −700V to about −800V.

Figure 2:
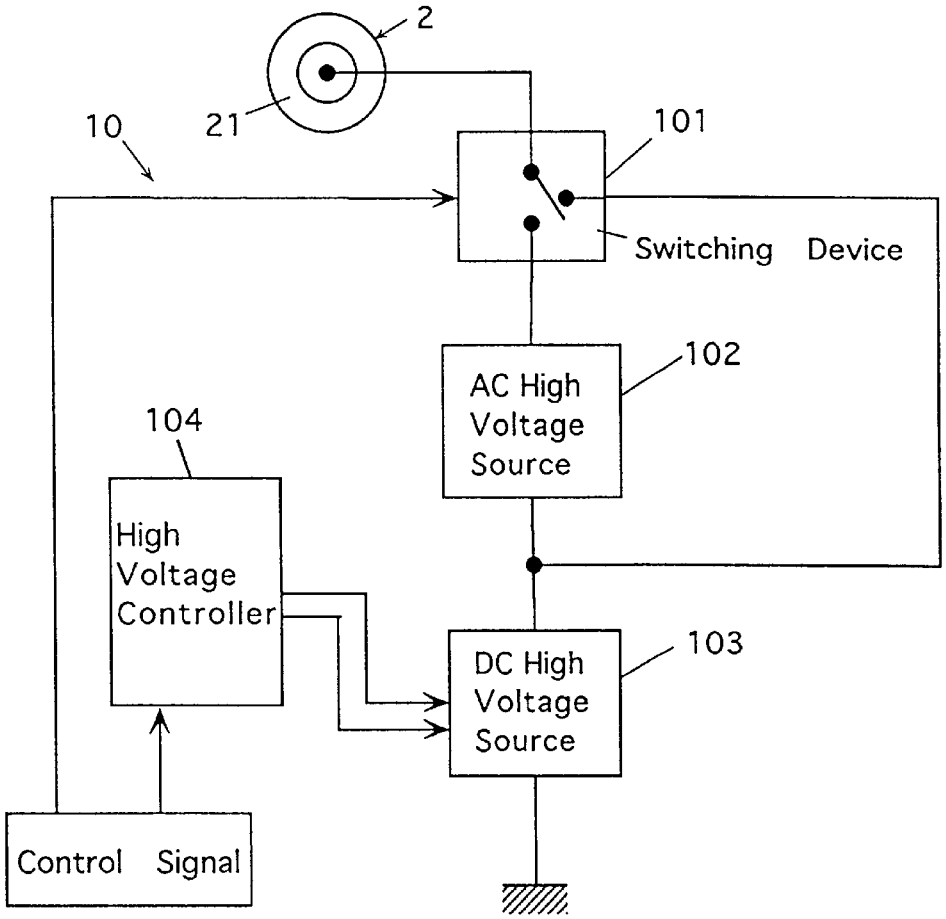
FIG. 2 is a block diagram of a power source circuit for a charging device in the printer in FIG. 1.

More specifically, the power source 10 is of a type shown in FIG. 2, in which a charging device 2 is connected to a switching device 101, an AC high voltage source 102 and a DC high voltage source 103, and the output voltage of the DC high voltage source 103 can be switched by a high voltage controller 104 between two values and also can be cut off. The high voltage control circuit 104 is constructed to operate in accordance with a control signal sent from a control unit (not shown) for controlling an entire operation of the printer.

Here, the AC high voltage power source 102 can supply a voltage having a frequency of 100 Hz and a peak-to-peak voltage $V_{p-p}$ of 1000V. The output voltage of the DC high voltage power source 103 can be switched between −800V and −1200V.

According to the power source 10, the control signal sent from the control unit (not shown) for controlling the whole operation of the printer can act to apply to the charging device 2 an oscillating voltage of maximum value of −300V to minimum value of −1300V, which is formed of a DC component of −800V supplied from the DC high voltage power source 103 and an oscillating component having a frequency of 100 Hz and peak-to-peak voltage $V_{p-p}$ of 1000V supplied from the AC high voltage power source 102 and added to the DC component while at least an image forming region of the surface of the photosensitive drum 1 is passing over the charging device 2. Also, the control signal can act to apply to the charging device 2 a DC voltage, which is formed of only the DC component of −1200V supplied from the DC high voltage power source 103, in accordance with a predetermined timing, while an image non-forming region of the surface of the photosensitive drum 1 is passing over the charging device 2.

The exposing device 3 utilizes a known semiconductor laser, and is adjusted to form an electrostatic latent image on an image forming portion of the surface of the photosensitive drum 1, which is charged to the predetermined potential Vo (volt), by reducing it to about −50V with laser radiation.

The developing device 4 is a mono-component developing device, and has such a structure that a drive roller 42 to be driven to rotate clockwise (in the direction of arrow β) is supported by a casing 41, a flexible developing sleeve 43 having an inner diameter slightly larger than the outer diameter of the roller 42 is fitted around the roller 42, opposite ends of the sleeve 43 are pressed against the drive roller 42 by pressing belt members 44 inside the casing 41 to form a slack portion 430 at the opposite side, and the slack portion 430 is in contact with the photosensitive drum 1. The developing sleeve 43 is in contact with a restriction blade 45 made of metal and located inside the casing 41.

Developer contained in the casing 41 is nonmagnetic mono-component toner T which can be charged negatively. The toner T is stirred by a stirring member 46 rotated counterclockwise in the figure and is supplied onto a toner transporting roller 47. The roller 47 is driven to rotate clockwise in the figure for moving the toner T toward the developing sleeve 43. In accordance with rotation of the drive roller 42, the developing sleeve 43 is frictionally driven in the same direction by the drive roller 42, while the restriction blade 45 frictionally charges the toner T and adheres the toner T at a constant rate onto the developing sleeve 43. In accordance with the rotation, the developing sleeve 43 successively supplies the toner T to a portion which is in contact with the photosensitive drum 1.

A power source (not shown) applies to the developing sleeve 43 a developing bias voltage Vb of −308V, by which the toner T can be adhered onto an electrostatic latent image on the surface of the photosensitive drum 1. Meanwhile, with respect to a non-imaging portion at which no image is to be formed, the surface potential Vo of the photosensitive drum 1 and the developing bias voltage Vb form an electric field, by which the toner T is forced to move toward the developing sleeve 43, so that the toner T does not adhere to the photosensitive drum 1. A transfer voltage Vt is applied to the transfer roller 51 from a power source (not shown).

According to the printer described above, the image forming area of the surface of the photosensitive drum 1 which is driven to rotate is uniformly charged to attain the surface potential Vo of −800V by the rotary contact charging device 2, and the exposing device 3 effects an image exposure on the charged area to form an electrostatic latent image. The surface potential of the exposed portion lowers to about −50V. The electrostatic latent image thus formed is developed into a toner image by the developing device 4 with the developing bias voltage Vb of −308V.

The roller type transfer device 5 transfers the toner image thus formed onto a sheet of paper 7 supplied from a transfer sheet supply device (not shown). After the transfer, the sheet 7 moves to a fixing device (not shown) to fix the toner image to the sheet 7, and then is discharged.

However, the toner on the photosensitive drum 1 is not entirely transferred onto the sheet 7 by the transfer device 5, but 10–20% of the toner generally remains as the residual toner on the photosensitive drum 1.

A part of the residual toner, which is charged normally (i.e., negatively in this embodiment) and is located on the non-imaging portion (i.e., on the non-imaging portion in not only the image non-forming region but also the image forming region on the photosensitive drum 1), is collected to the developing sleeve 43 when it reaches the developing device 4. Thus, the normally charged residual toner on the non-imaging portion is forced to move toward the developing sleeve 43 by the electric field formed by the surface potential Vo of the photosensitive drum 1 and the developing bias voltage Vb, so that it moves onto the developing sleeve 43 and is collected into the developing device 4 owing to the force generated by the electric field as well as the scraping force generated by sliding contact of the developing sleeve 43 on the surface of the photosensitive drum 1.

While an image forming region is passing over the charging device 2, a part of the untransferred residual toner, which is located at the image forming region on the photosensitive drum 1, is sufficiently disturbed into an unpatterned form owing to the physical toner disturbing and scattering effect by the charging rotary brush 21 and the application of the oscillating voltage from the power source 10 to the charging device 2. This oscillating voltage is formed of the DC component of −800V and the superimposed oscillating component having a frequency of 100 Hz and the peak-to peak voltage of 1000V, and has the maximum value of −300V and the minimum value of −1300V, as already described. Therefore, the image forming region on the photosensitive drum 1 is uniformly charged, and generation of a residual memory (retransferred memory) and an image memory is suppressed, so that a good image can be formed.

While the image non-forming region is passing over the charging device 2, the rest of the untransferred residual toner, which is located at the image non-forming region on the photosensitive drum 1, is disturbed into the unpatterned form owing to the physical toner disturbing and scattering effect by the charging rotary brush 21. Also defectively charged toner such as the oppositely charged toner and uncharged toner at the image non-forming region is recharged to attain the normal polarity owing to application of the voltage, which is formed of only the DC component of −1200V, from the power source 10 to the charging device 2 in accordance with a predetermined timing, as already described. Thereby, accumulation of toner onto the rotary brush 21 is suppressed, and the subsequent collecting of toner by the developing device 4 can be performed smoothly.

In this embodiment, the foregoing timing, according to which the DC voltage formed of only the DC component of −1200V is applied, is set within a pre-sequence or period after activation of the printer and before start of the image formation, and within an end sequence or period after formation of the image formation.

The operation timings of major portions of the printer will be described below with reference to FIGS. 3 and 4.

Figure 3:
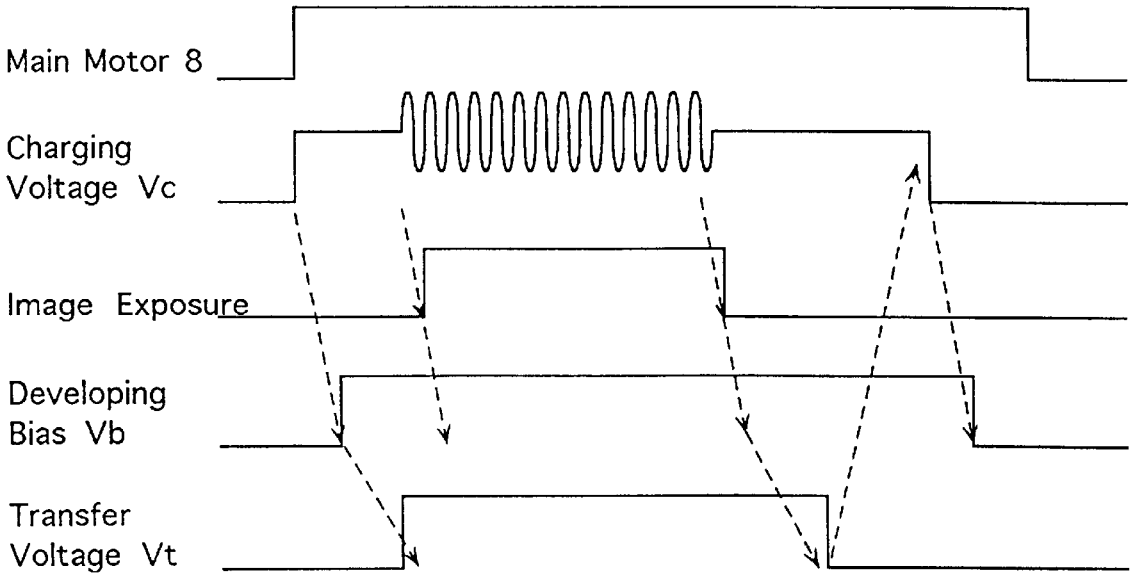
FIG. 3 is a time chart showing operation timings of respective portions of the printer in FIG. 1.

FIG. 3 shows operation timings of on/off of the main motor 8, switching of the charging voltage Vc by the power source 10, on/off of the exposing device 3, on/off of the developing bias voltage Vb in the developing device 4, and on/off of the transfer voltage Vt in the transfer device 5.

Figure 4:
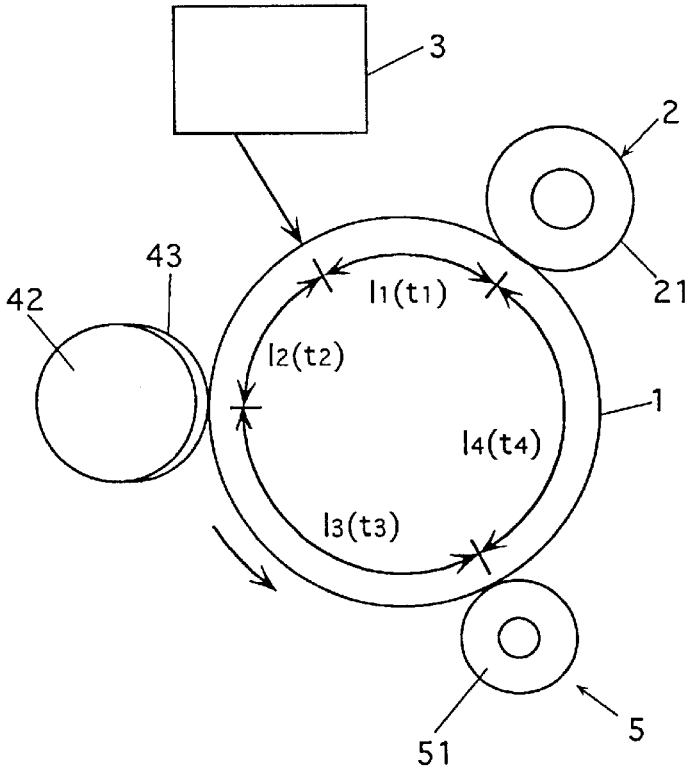
FIG. 4 shows element spacings around the photosensitive drum in the printer in FIG. 1 and times required for movement of one point on the photosensitive drum through these spacings.

FIG. 4 shows peripheral distances $l_1$, $l_2$, $l_3$ and $l_4$ on the photosensitive drum 1 corresponding to distances or spacings between elements arranged around the photosensitive drum 1 as well as times $t_1$, $t_2$, $t_3$ and $t_4$ required when one point on the surface of the photosensitive drum 1 moves these distances.

$l_1$ represents the distance from the charging rotary brush 21 to an image exposing beam radiating portion.

$l_2$ represents the distance from the exposing beam radiating portion to the contact portion of the developing sleeve 43.

$l_3$ represents the distance from the developing sleeve contact portion to the transfer roller 51.

$l_4$ represents the distance from the transfer roller 51 to the rotary brush 21.

Assuming that Vpc represents the peripheral speed of the drum 1, the following formula can be obtained:

$$t_1=l_1/Vpd, t_2=l_2/Vpc, t_3=l_3/Vpc \text{ and } t_4=l_4/Vpc$$

Assuming that the peripheral length of the photosensitive drum 1 is $l_0$, a time $t_0$ required for movement of a distance corresponding to one rotation of the photosensitive drum can be expressed by the formula of $t_0=l_0/Vpc$.

Here, the diameter of the photosensitive drum is 30 mm, and the system speed (equal to the peripheral speed Vpc of the drum 1) is 37.77 mm/sec, so that the following specific values can be obtained. The unit of distance is millimeter, and the unit of time is second.

| | |
|---|---|
| $l_1$ = 20.24 | $t_1$ = 0.536 |
| $l_2$ = 14.51 | $t_2$ = 0.384 |
| $l_3$ = 28.72 | $t_3$ = 0.760 |
| $l_4$ = 30.78 | $t_4$ = 0.815 |
| $l_0$ = 94.25 | $t_0$ = 2.495 |

The operation timings of the respective portions shown in FIG. 3 are as follows.

(1) First, in response to a print instruction, the main motor 8 of the printer is turned ON, and rotary portions, i.e., the rotary brush 21 of the charging device 2, the developing sleeve 43 and others of the developing device 4, the transfer roller 51 of the transfer device 5 and rotary portions of the fixing device are driven to rotate. At the same time, the charging voltage Vc, i.e., DC voltage of −1200V is applied to the rotary brush 21, and the surface of the photosensitive drum 1 is uniformly charged to −800V.

(2) Application of the developing bias voltage Vb of −308V to the developing sleeve 43 starts with a delay of time of ($t_1$+$t_2$) (0.92 sec) so as not to develop an uncharged portion of the photosensitive drum 1.

(3) The exposing device 3 starts the image exposure at the same time as the transportation of the transfer sheet 7 by the transfer sheet supply device (not shown). At a point of time preceding the above by a slight time (0.8 sec) larger than the time $t_1$ (0.536 sec), the charging voltage Vc is switched to the voltage formed of the DC component of −800V and the oscillating component of the frequency of 100 Hz and the peak-to peak voltage of 1000V.

(4) The image exposure continues for a predetermined time corresponding to the length of the transfer sheet. At a point of time preceding the end of the image exposure by a time shorter than $t_1$, the charging voltage Vc is switched to DC voltage of −1200V.

(5) After the end of light beam radiation for the image exposure, the charging voltage is cut off (application voltage is set to 0V) after elapsing of a time not shorter than ($t_2$+$t_3$+$t_4$), i.e., until at least the downstream end of the image-exposed portion moves through the developing and transfer stages and passes through the rotary brush 21 again.

(6) After cut-off of the charging voltage, the developing bias is cut off upon elapsing of ($t_1$+$t_2$) time.

(7) After the transfer sheet 7 is subjected to the toner image fixing, it is discharged from the printer, and the main motor 8 stops.

The printer described above was tested by printing a chart of B/W ratio of 5% on 5000 sheets. Base fogging hardly occurred, and a good image quality could be achieved. At this time, the base fogging rank was 4, and the quantity of toner accumulated on the charging rotary brush 21 (i.e., quantity of smearing toner) was of a small value of 8.4 mg/cm, which was measured as a value per one circle of the rotary brush per 1 cm in the longitudinal direction of the rotary brush.

The evaluation of the base fogging was ranked into five by visually comparing the printed images with allowable limit samples.

| Base Fogging Rank | Evaluation |
|---|---|
| 5 | very good |
| 4 | good |
| 3 | acceptable |
| 2 | unacceptable |
| 1 | bad |

As described above, the oscillating voltage was applied for the image forming region, and the DC voltage formed of only the DC component was applied for the image non-forming region corresponding to the pre-sequence and the end sequence, so that the toner smearing of the rotary brush 21 of the charging device 2 was suppressed, memories such as an image memory could be effectively prevented, and base fogging was suppressed, whereby good images could be obtained for a long term. No lowering of density of the whole image was found.

As described above, in the case where the voltage formed of only the DC component is applied to the charging device 2 for the image non-forming region, the untransferred residual toner is hardly accumulated on the rotary brush 21, and the base fogging hardly occurs. The reason for this can be considered as follows.

Thus, in the case where the voltage (of negative polarity) formed of only the DC component is applied thereto, charging by the discharging starts at the noncontact portion located upstream and close to an area through which the charging rotary brush 21 and the photosensitive drum 1 contact each other. Therefore, even if the residual toner after the transfer has the opposite polarity (positive polarity), it is strongly charged by the discharging to have the normal polarity (negative polarity). Accordingly, when it moves immediately under the rotary brush 21, the toner hardly adheres to the rotary brush 21 because the brush 21 and the toner have the same polarity. Further, owing to the normal polarity, it is sufficiently collected by the developing device 4, and thus it does not remain on the photosensitive drum 1.

[Embodiment 2]

Figure 5:
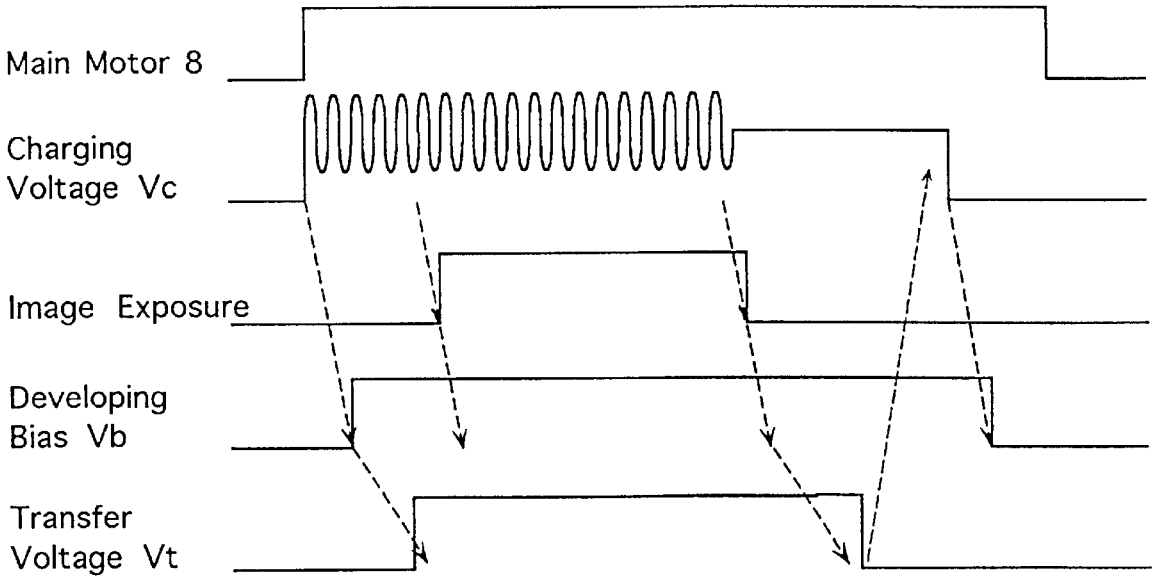
FIG. 5 is a time chart showing operation timings of respective portions of a printer of another embodiment.

In the printer of the embodiment 1, the control signal supplied to the power source 10 is changed, and the DC voltage is selected only in the end sequence or step as shown in FIG. 5.

[Embodiment 3]

Figure 6:
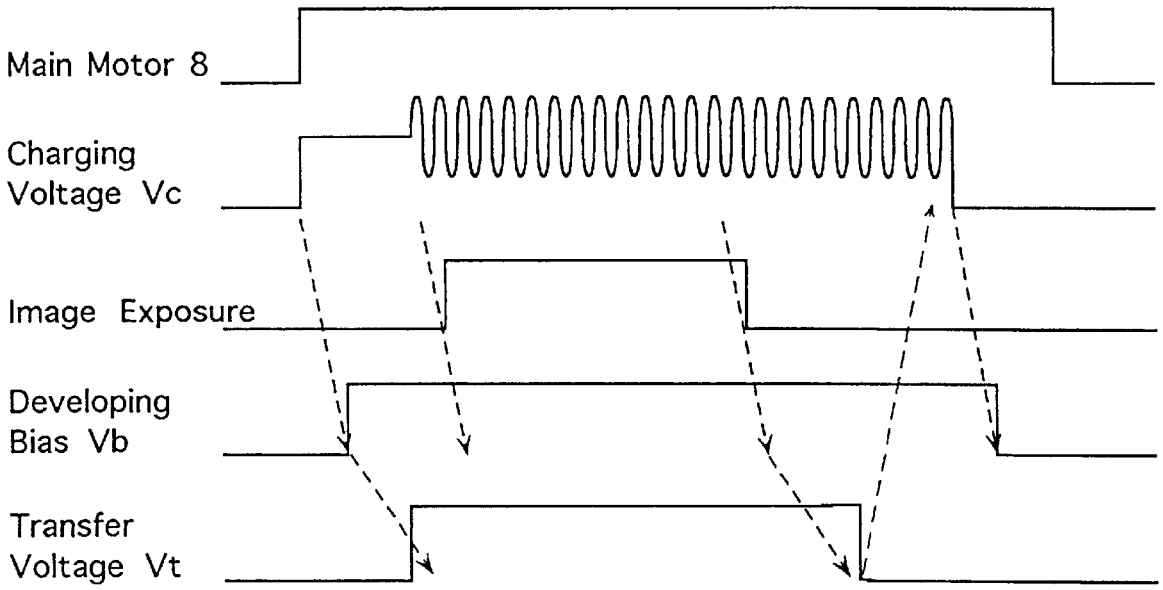
FIG. 6 is a time chart showing operation timings of respective portions of a printer of still another embodiment.

In the printer of the embodiment 1, the control signal supplied to the power source 10 is changed, and the DC voltage is selected only in the pre-sequence as shown in FIG. 6.

Even the printers of the embodiments 2 and 3 can suppress disadvantageous base fogging, although the degree of effect is different from that by the embodiment 1.

[Embodiment 4]

Figure 7:
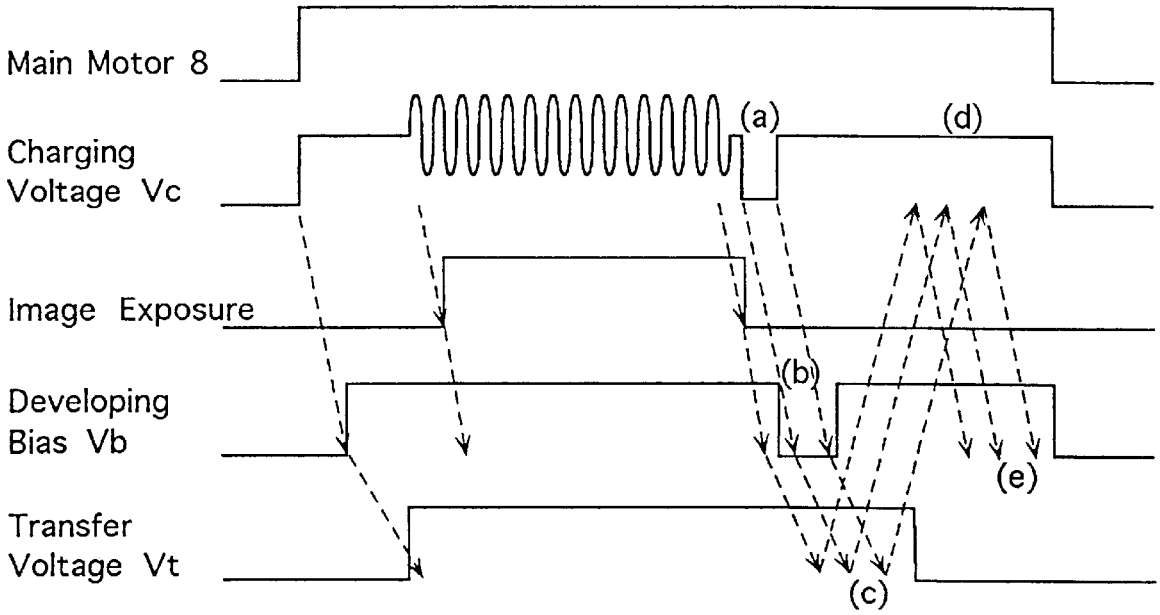
FIG. 7 is a time chart showing operation timings of respective portions of a printer of yet another embodiment.

In the printer of the embodiment 1, the control signal supplied to the power source 10 is changed, and the printer operates in accordance with the sequence shown in FIG. 7, as will be described below.

Steps preceding the image exposure are the same as those of the embodiment 1.

Prior to the end of the image exposure, and more specifically, at a point of time preceding it by a slight time shorter than the time $t_1$, the charging voltage Vc is switched from the oscillating voltage to the DC voltage of −1200V.

(a) After this switching to the DC voltage of −1200V, the voltage (charging voltage) applied to the charging device 2 is set to 0V while the rotary brush 21 makes 2–5 rotations. Thereby, the toner adhering to the rotary brush 21 is released onto the photosensitive drum 1.

(b) The developing bias is cut off so as to prevent developing of the uncharged portion at (a). Negatively charged toner in the released toner is collected, but a majority of uncharged toner and oppositely charged toner is not collected.

(c) In order to prevent smearing by adhesion of the oppositely charged toner onto the transfer roller, the transfer voltage Vt is still applied.

(d) A DC voltage is applied during one or more rotation of the photosensitive drum 1 after (a), and, the toner released at (a), i.e., the uncharged toner and oppositely charged toner are negatively discharged to attain the normally (negatively) charged state.

(e) After (b), the developing bias Vb is turned on to collect the toner recharged at (d) to the developing device 4.

The printers described above were tested by printing a chart of B/W ratio of 5% on 5000 sheets similarly to the embodiment 1. Image memory and base fogging did not occur, and a good image quality could be achieved. At this time, the base fogging rank was 4–5, and the quantity of smearing toner on the charging rotary brush 21 was 3.2 mg/cm. Lowering of the density of the whole image was not found.

According to this printer, the toner adhering to the rotary brush 21 can be positively released onto the photosensitive drum 1, and the released toner can be recharged to attain the normal polarity, so that smearing of the rotary brush 21 by the adhered toner can be suppressed for a long term, and the charging device 2 can be stably used for a long term. Owing to this, the invention may be applied, for example, to such an image forming apparatus that the photosensitive drum, developing device and others are constructed to form one unit and the unit can be entirely exchanged for reuse upon exhaustion of the developer or the like, whereby it is not necessary to arrange the charging device in the unit, so that a cost of the exchangeable unit can be reduced and the entire running cost of the image forming apparatus can be reduced.

Description will now be given on experimental examples for comparison.

[Example 1 for Comparison]

The printer in FIG. 1 was used to print a chart of B/W ratio of 5% on 5000 sheets, although only the oscillating voltage is applied to the charging device 2. Conspicuous base fogging of the image occurred, the rotary brush 21 was significantly smeared, and smear by leakage of the toner occurred. The base fogging rank was 1–2.

[Example 2 for Comparison]

The printer in FIG. 1 was used to print a chart of B/W ratio of 5% on 5000 sheets, although only the DC voltage of −1200V was applied to the charging device 2. An image memory occurred.

Results of the experiments by the embodiment 1 and 4 as well as examples 1 and 2 for comparison are as follows. Image memory "O" represents "no image memory", and "X" represents "occurrence thereof".

Results of 5000 Printing of B/W 5% Chart

| | Image Memory | Base Fogging | Smear of Brush 21 by Toner (mg/cm) |
|---|---|---|---|
| Embodiment 1 | ○ | 4 | 8.4 |
| Embodiment 4 | ○ | 4–5 | 3.2 |
| Example 1 | ○ | 1–2 | 50.5 |
| Example 2 | X(*1) | — | — |

*1: occurred at the initial stage

According to the embodiments of the invention described above, memories such as an image memory caused by the untransferred residual toner can be sufficiently suppressed as a whole, and unignorable base fogging and reduction of the entire image density can be prevented for a long term, so that good images can be obtained.

Figure 8:
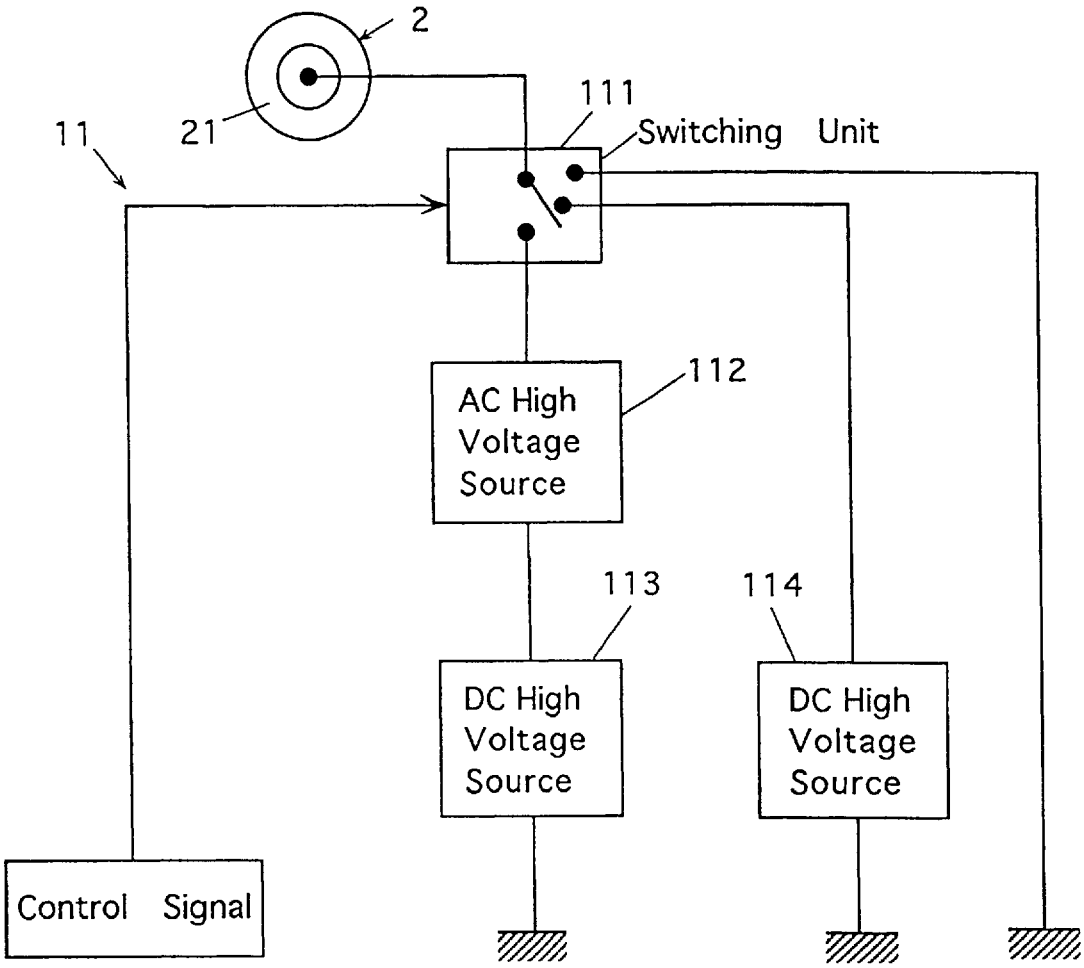
FIG. 8 is a block circuit diagram of another example of a power source for a charging device.

The printer of the embodiment 4 may employ a power source 11 of a type shown in FIG. 8 for applying the voltage to the charging device 2, instead of the power source 10 shown in FIG. 2. In the power source 11 shown in FIG. 8, a switching unit 111, an AC high voltage source 112 and a DC high voltage source 113 are connected to the charging device 2, and a DC high voltage source 114 connected to the switching unit 111 is arranged in parallel to the sources 112 and 113. Further, the switching unit 111 is grounded in a parallel form, and is operated to perform the switching by a control signal sent from a control unit (not shown) for controlling entire operation of the printer. In this case, operation similar to that of the power source 10 in the printer of the embodiment 4 can be performed in such a manner that the AC high voltage power source 112 applies an AC voltage of a frequency of 100 Hz and a peak-to-peak voltage of 1000V, the DC high voltage power source 113 applies a DC voltage of −800V, and the DC high voltage power source 114 applies a DC voltage of −1200V. Further, power sources 112 and 113 are used when the image forming region is to be charged prior to formation of an electrostatic latent image. The power source 114 is used when defectively charged toner is to be charged to have the normal polarity in the pre-sequence. If the toner is to be released from the rotary brush 21 in the end sequence, the ground potential is set, and the power source 114 is used if the defectively charged toner is to be charged normally thereafter.

Figure 9A:
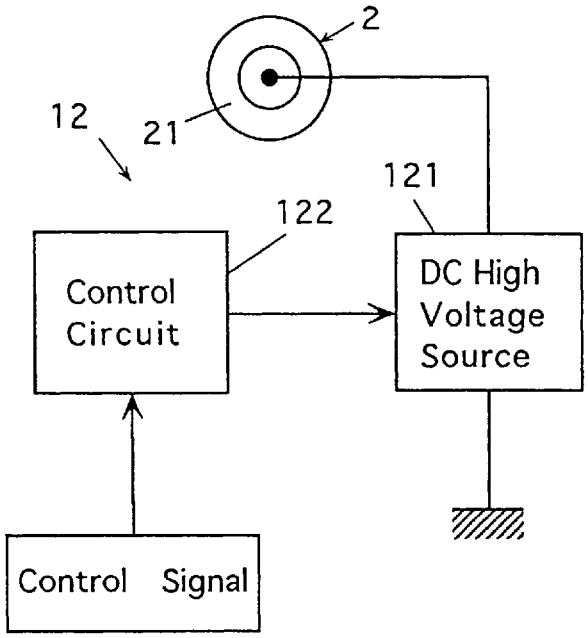
FIG. 9(A) is a block circuit diagram of still another example of power source for a charging device.

In each of the printers of embodiments 1 through 4, a power source 12 of a type shown in FIG. 9(A) can be employed instead of the power source 10.

Figure 9B:
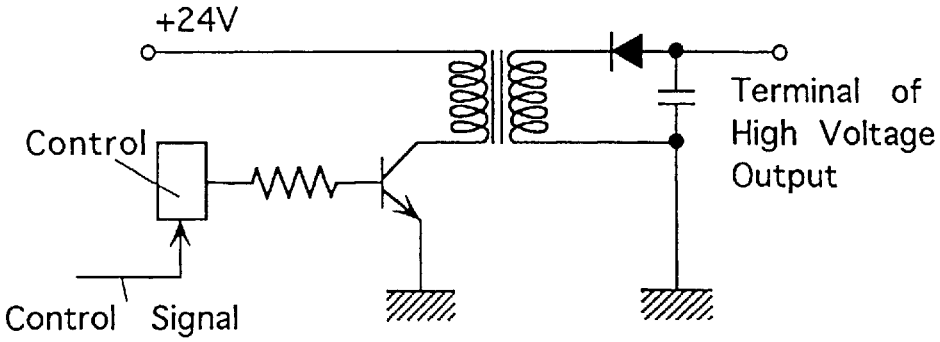
FIG. 9(B) is a circuit diagram showing a specific example of a circuit structure of the power source in FIG. 9(A)

According to the power source 12 in FIG. 9(A), a single DC high voltage power source 121 is connected to the charging device 2, a control circuit 122 is supplied with a control signal from a control unit (not shown) for controlling entire operation of the printer, and the control circuit 122 can switch the output of the power source 121 between three types of voltages, i.e., an oscillating voltage in which a DV voltage is repetitively turned on and off with a predetermined cycle, a non-oscillating continuous DC voltage and 0V. More specifically, a circuit structure, e.g., shown in FIG. 9(B) is employed to provide the control signal formed of a pulse signal of a predetermined frequency, whereby the oscillating voltage can be obtained. This power source does not require an AC high voltage power source, which allows reduction of the size and cost of the printer.

Figure 10:
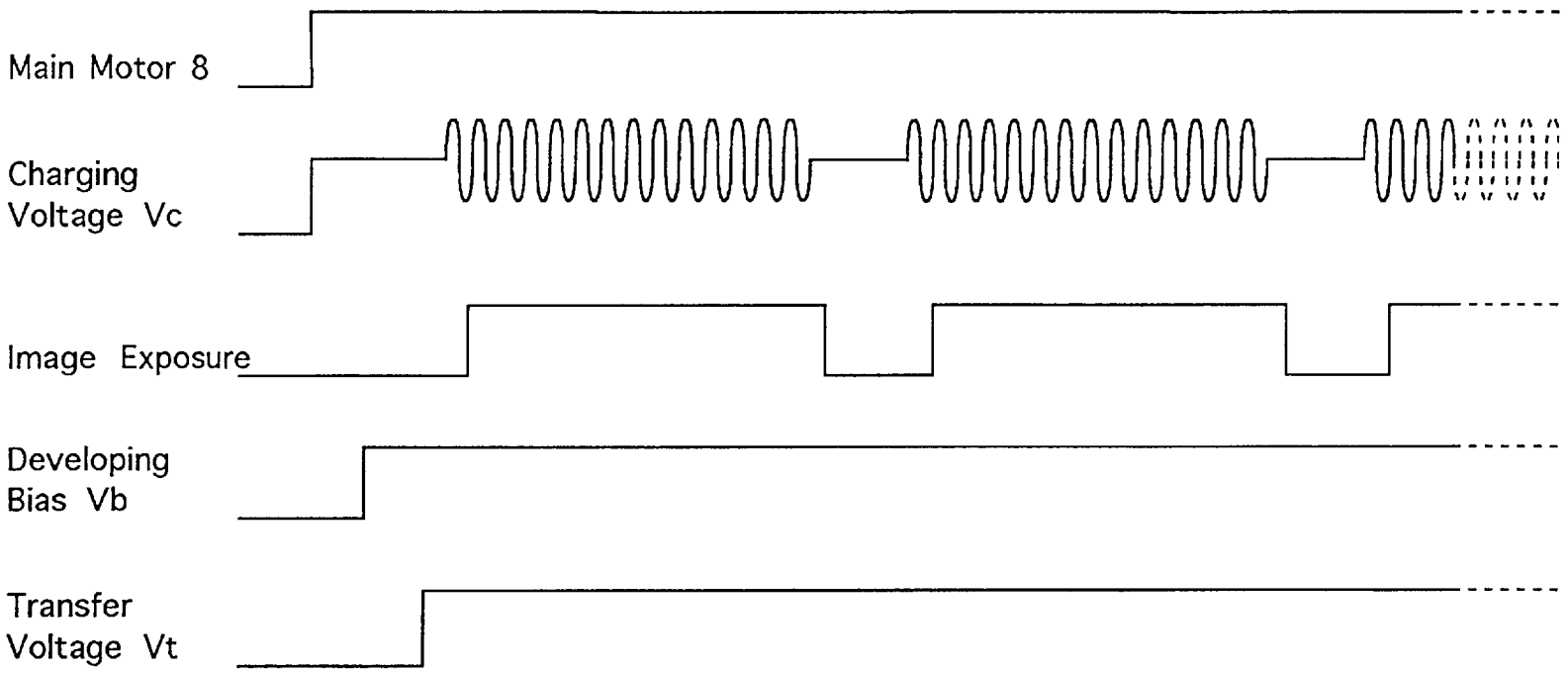
FIG. 10 is a time chart showing operation timings of respective portions of a printer of further another embodiment.
Figure 11:
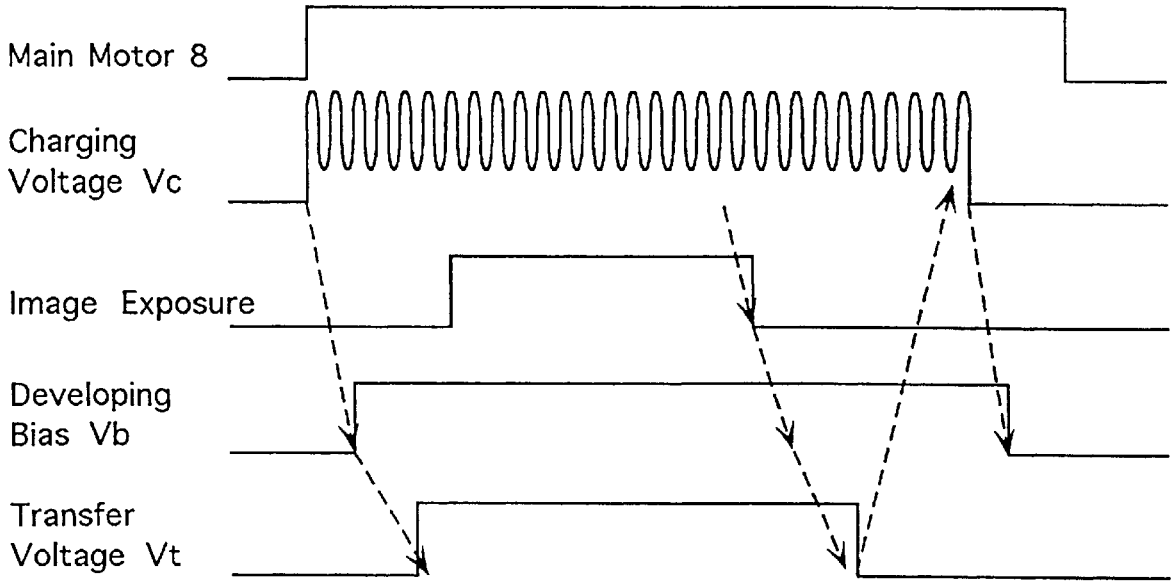
FIG. 11 is a time chart showing operation timings of respective portions of a printer of an example for comparison, and FIG. 12 a time chart showing operation timings of respective portions of a printer of another example for comparison.
Figure 12:
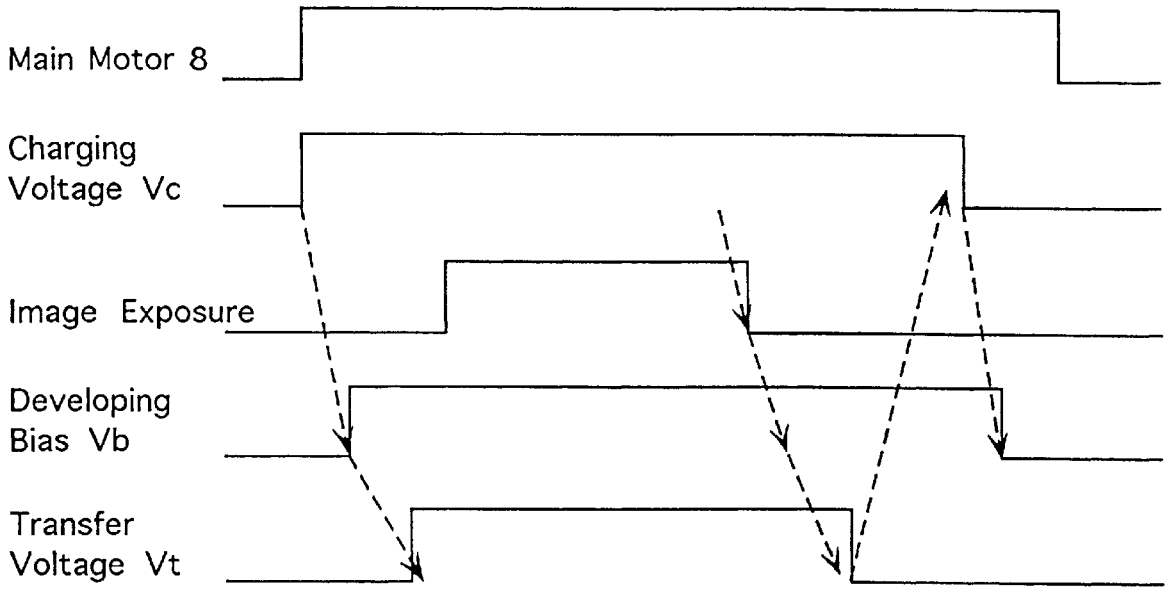

Although in the embodiments described above, an inter-image sequence for continuously performing the printing is not mentioned, the voltage Vc applied to the charging device 2 can be switched to the DC voltage composed of a DC component as exemplified in FIG. 10 even in such an inter-image sequence, and further, the switching can be performed such that the DC voltage value is temporarily set to 0V or the ground voltage.

Although the image forming apparatuses of the embodiments already described employ the photosensitive member of a drum type, a photosensitive member of another rotary type such as an endless belt type may be employed.

As described above, the present invention provides the image forming apparatus, which includes the photosensitive member, the rotary contact charging device supplied with the voltage from the power source for charging the surface of the photosensitive member, and the developing device for forming a visible toner image by developing the electrostatic latent image formed by image exposure on the region of the photosensitive member charged by the charging device, and in which the rotary contact charging device disturbs the toner, which remains on the surface of the photosensitive member after transfer of the visible toner image onto the transfer member, into an unpatterned form and charges the photosensitive drum surface, and the developing device collects the toner remaining on the photosensitive member after the transfer and simultaneously developing the electrostatic latent image. In the image forming apparatus, memories such as an image memory due to the untransferred residual toner can be sufficiently suppressed, and good images can be obtained by suppressing unignorable base fogging and reduction of entire image density for a long term.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus which does not use a dedicated cleaning device, said apparatus comprising:

a photosensitive member having a surface;

a rotatable charging brush which is in contact with said surface of said photosensitive member, said rotatable charging brush charging the surface of said photosensitive member to form an electrophotographic latent image by image exposure;

a power source for applying electric power to said rotatable charging brush;

a developing device for developing said latent image by developer charred to a normal polarity and for collecting residual developer remaining on said surface of said photosensitive member after a thus developed image is transferred to a transfer member; and control means for controlling said power source to apply an oscillating voltage composed of a direct current component and an alternating current component to said rotatable charging brush while said rotatable charging brush contacts a part of said surface of said photosensitive member on which an image is to be formed so as to charge said surface uniformly and to disturb the residual developer residing on said surface of said photosensitive member into an unpatterned form, and to apply only a direct current component to said rotatable charging brush for at least a predetermined time while said rotatable charging brush contacts a part of said surface of said photosensitive member in which no image is to be formed so as to charge any uncharged or oppositely charged residual developer to the normal polarity.

2. The image forming apparatus as claimed in claim 1, wherein said developing device develops the latent image with a mono-component developer.

3. The image forming apparatus as claimed in claim 1, wherein said control means switches the voltage of the direct current component applied by said power source from a first level to a second level, at which a gap of potential with respect to a ground voltage is smaller than that of the first level, to release developer adhering to said rotatable charging brush onto said surface of said photosensitive member, and thereafter switches said voltage of the direct current component from said second level to said first level.

4. The image forming apparatus as claimed in claim 3, wherein said second level is a ground voltage.

5. The image forming apparatus as claimed in claim 1, wherein said control means applies the oscillating voltage by periodically switching the direct current component applied by said power source.

6. An image forming apparatus which does not use a dedicated cleaning device, said apparatus comprising:

a photosensitive member having a surface;

a rotatable charging brush which is in contact with the surface of said photosensitive member, said rotatable charging brush charging the surface of said photosensitive member;

an exposure device for exposing an image and forming an electrophotographic latent image on the surface of said photosensitive member charged by said rotatable charging brush;

a DC power source for applying an amount of direct current electric power to said rotatable charging brush;

an AC power source for applying an amount of alternating current electric power to said rotatable charging brush;

a developing device for developing the latent image by developer charged to a normal polarity and for collecting residual developer remaining on said surface of said photosensitive member after the developed image is transferred to a transfer member; and control means for operating both said DC power source and said AC power source while said rotatable charging brush contacts a portion of said surface of said photosensitive member in which the latent image is to be formed by said exposure device so as to charge said surface uniformly and to disturb the residual developer residing on said surface of said photosensitive member into an unpatterned form, and for operating only said DC power source for at least a predetermined time while said rotatable charging brush contacts a remaining portion of said surface of said photosensitive member so as to charge any uncharged or counter charged residual developer to the normal polarity.

7. The image forming apparatus as claimed in claim 6, wherein said developing device develops the latent image with a mono-component developer.

8. The image forming apparatus as claimed in claim 6, wherein said control means switches the voltage to be applied during a period for operating only the DC power source from a first level to a second level in which a gap of potential with respect to a ground voltage is smaller than that of the first level to release developer adhering to said rotatable charging brush onto said photosensitive member, and thereafter switches the applied voltage from said second level to said first level and rotates said photosensitive member more than one rotation.

9. The image forming apparatus as claimed in claim 8, wherein said second voltage is a ground voltage.

10. The image forming apparatus as claimed in claim 6, wherein said control means provides for a first amount of the direct current electric power to be applied by the power source to the rotatable charging brush when applying an amount of alternating current electric power to the rotatable charging brush, and provides for a second amount of the direct current electric power to be applied by the power source to the rotatable charging brush when applying only a direct current electric power to the rotatable charging brush.

11. The image forming apparatus as claimed in claim 1, wherein said control means provides for applying a first amount of the direct current component when applying the oscillating voltage and provides for applying a second amount of the direct current component when applying only a direct current component.

12. An image forming apparatus comprising:

an image receiving surface on which an image is formed;

a rotatable charging brush which is in contact with said image receiving surface, said rotatable charging brush being rotatably mounted for charging said image receiving surface;

an image forming means for forming a toner image on said image receiving surface previously charged by said rotatable charging brush by using toner particles charged to a normal polarity:

an electrical power source; and a controller which controls said electrical power source to apply an oscillating voltage, composed of a direct current component and an alternating current component, to said rotatable charging brush while said rotatable charging brush is in contact with a portion of said image receiving surface on which an image is to be formed by said image forming means so as to charge said surface uniformly and to disturb a residual toner image residing on said surface into an unpatterned form, and to apply a voltage having only a direct current component for at least a predetermined time while said rotatable charging brush is in contact with a portion of said image receiving surface on which no image is to be formed so as to charge any uncharged or counter charged residual toner particles to the normal polarity.

13. An image forming apparatus in accordance with claim 12, said image forming means comprising:

an exposure device for exposing said image receiving surface to form an electrical latent image on said image receiving surface; and a developing device, which accommodates toner particles, for forming a toner image on said image receiving surface in accordance with the latent image.

14. An image forming apparatus in accordance with claim 13, wherein said developing device collects residual toner particles from said image receiving surface.

15. An image forming apparatus in accordance with claim 12, wherein said image receiving surface is a photosensitive surface.

16. An image forming apparatus in accordance with claim 15, further comprising an exposure device having a light source.

* * * * *

UNITED STATES PATENT AND TRADEMARK OFFICE

CERTIFICATE OF CORRECTION

PATENT NO. : 5,845,172

DATED : December 1, 1998

INVENTOR(S) : Hitoshi SAITO et al.

It is certified that error appears in the above-identified patent and that said Letters Patent is hereby corrected as shown below:

Column 13, Line 22; delete "charred" and insert --charged--.

Signed and Sealed this

Twenty-first Day of December, 1999

*Attest:*

Q. TODD DICKINSON

*Attesting Officer*

*Acting Commissioner of Patents and Trademarks*